United States Patent [19]

Tanaka

[11] 4,160,933

[45] Jul. 10, 1979

[54] ACCIDENTAL FLASH PREVENTION IN A PHOTOGRAPHIC FLASH DEVICE

[75] Inventor: Kazuo Tanaka, Neyagawa, Japan

[73] Assignee: West Electric Company, Ltd., Osaka, Japan

[21] Appl. No.: 831,525

[22] Filed: Sep. 8, 1977

[30] Foreign Application Priority Data

Sep. 30, 1976 [JP] Japan ..... 51-118132

[51] Int. Cl.[2] ..... H05B 41/32

[52] U.S. Cl. ..... 315/241 P; 354/145

[58] Field of Search ..... 315/241 P, 134, 136; 354/145

[56] References Cited

U.S. PATENT DOCUMENTS

| | | | |
|---|---|---|---|
| 3,814,985 | 6/1974 | Pecher et al. | 315/241 P |
| 3,878,433 | 4/1975 | Sato | 315/241 P |
| 3,890,538 | 6/1975 | Iwata et al. | 315/241 P |

FOREIGN PATENT DOCUMENTS

| | | | |
|---|---|---|---|
| 1050909 | 2/1959 | Fed. Rep. of Germany | 315/241 P |

*Primary Examiner*—Eugene R. LaRoche

*Attorney, Agent, or Firm*—Cushman, Darby & Cushman

[57] ABSTRACT

In a photographic flash device comprising a flash discharge tube, for example a xenon discharge tube, a main capacitor which is connected across electrodes of said flash discharge tube and is for storing electric charge to be discharged in said flash tube, a triggering capacitor which is connected in series with a primary coil of a triggering transformer and a synchronous switch, and a voltage indicating glow discharge lamp for indicating completion of charging in the main capacitor.

A safety circuit for prohibiting accidental flashing is constituted by comprising a switching means which suspends function of said triggering capacitor.

13 Claims, 3 Drawing Figures

ACCIDENTAL FLASH PREVENTION IN A PHOTOGRAPHIC FLASH DEVICE

BACKGROUND OF THE INVENTION

This invention relates to an improvement in photographic flash device and particularly concerns a photographic flash device capable of eliminating accidental flashing.

In the conventional photographic flash device, a "ready"-indicating glow discharge lamp which indicates completion of charging of the main capacitor is already known. In using such photographic flash device, firstly a power switch is switched on thereby to charge the main capacitor, secondly, after confirming lighting of the "ready"-indicating glow discharge lamp, a triggering circuit is actuated by switching the synchronous switch on thereby to flash a xenon discharge lamp. The power switch of such flash device is kept off when the flashing is not made.

However, even when the power switch of the conventional flash device is off, if the main capacitor has a sufficient charge for a flashing, an inadvertent or accidental switching on of the synchronous switch causes an accidental flashing. In order to avoid such accidental flashing, the assignee hereof has already proposed an improvement of the flash device as disclosed in the U.S. Pat. No. 3,890,538 or in the U.K. Patent specification No. 1,408,710, wherein a safety switch interlocked with a power switch is provided in a triggering circuit of the flash device.

However, the abovementioned improved flash device provided with such interlocked safety switch still has another problem that, if a synchronous switch is inadvertently closed prior to the completion of charging of the main capacitor and the voltage of the main capacitor is above the threshold level for triggering flashing of the xenon-discharge tube, but the voltage is lower than the designed target voltage, then the xenon-discharge tube flashes with a smaller amount of electric charge than designed, thereby emitting smaller intensity of light than designed. Such flashing results in an underexposure photographing.

SUMMARY OF THE INVENTION

Accordingly, the purpose of the present invention is to provide an improved flash device capable of eliminating undesirable inadvertent flashing prior to a completion of charging of the main capacitor.

DETAILED DESCRIPTION OF THE INVENTION

The present invention is elucidated hereafter referring to preferred embodiments shown in the accompanying drawing.

Figure 1:
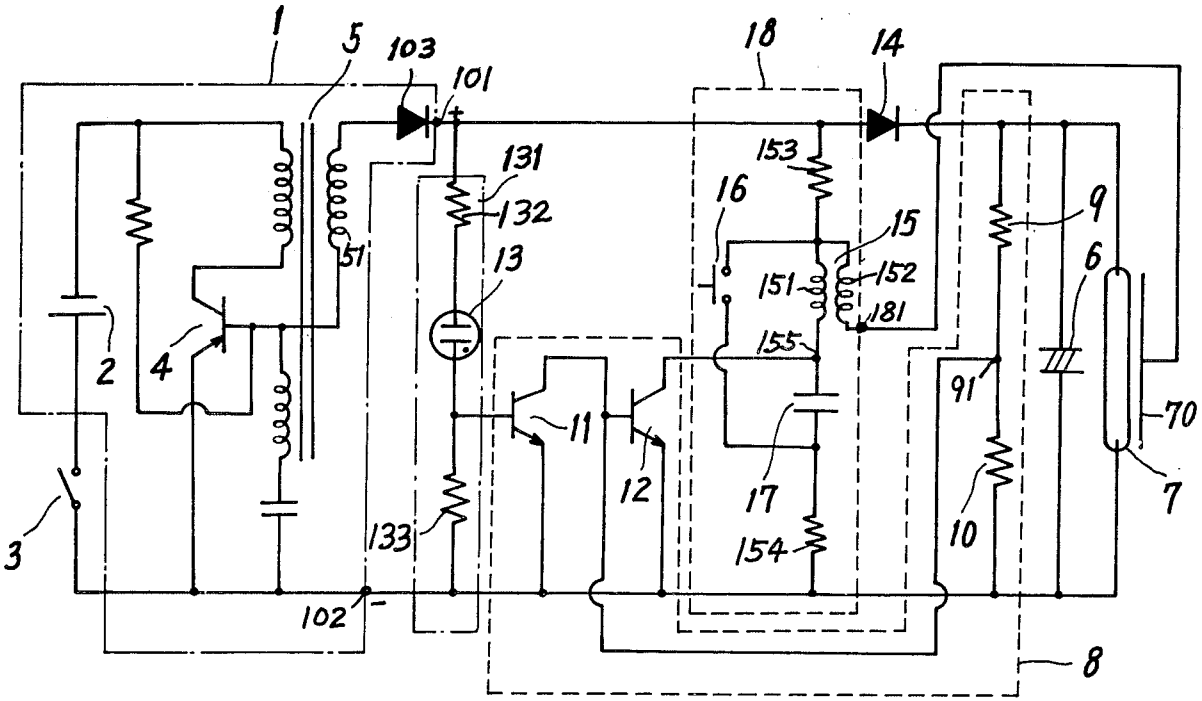
FIG. 1 is an electric circuit diagram of an example of the present invention.

FIG. 1 shows a fundamental example embodying the present invention, wherein the flash device comprises a DC power source 1, a main capacitor 6 to store electric charge, a xenon-discharge lamp as a flash discharge tube 7, a triggering circuit 18 to impress a triggering pulse to a triggering electrode 70, a safety circuit 8 to prevent undesirable accidental actuation of the triggering circuit 18, a voltage-indicating circuit 131 to indicate a charging-up of the main capacitor 6 and a diode 14 connected in series with the main capacitor.

Details of the construction of the circuit of FIG. 1 is as follows:

The DC power source 1 comprises a battery 2, an oscillation transistor 4, a converter transformer 5 and a rectifier diode 103 which is connected to an output terminal i.e. one end of a secondary coil 51 of the converter transformer 5. A power switch 3 is connected in series with the battery 2.

The voltage indicating circuit 131 comprises a series connection of a pair of resistors 132 and 133 and a glow discharge lamp 13 connected between the resistors 132 and 133. The series connection is connected across both output terminals 101 and 102 of the DC power source 1. The main capacitor 6 and the flash discharge tube 7 are connected in parallel with each other across the output terminals 101 and 102 of the DC power source 1 through a diode 14. The triggering circuit 18 comprises a triggering transformer 15, a primary coil of which is connected in series with a triggering capacitor 17 and further in series with a pair of resistors 153 and 154 across the output terminals 101 and 102. An output terminal 181 of the triggering circuit 18, namely an end of the secondary coil 152 of the triggering transformer 15 is connected to the triggering electrode 70 contacting the flash discharge tube 7. A synchronous switch 16 is connected across both ends of the series connection of the primary coil 151 and the triggering capacitor 17. The safety circuit 8 comprises a voltage dividing network consisting of a pair of resistors 9 and 10 connected across both ends of the main capacitor 6, a transistor 12 and another transistor 11. The transistor 12 is connected by its base to a voltage dividing point 91, namely the junction point 91 between the resistors 9 and 10, by its collector to the junction point 155 between the primary coil 151 and the triggering capacitor 17 and by its emitter to the output terminal 102, to which one end of the triggering capacitor 17 is connected through the resistor 154. In other words, the emitter is connected to one end of the resistor 154, the other end of which is connected to the triggering capacitor 17. The transistor 11 is connected by its base to the junction point between the glow discharge lamp 13 and the resistor 133, by its collector to the base of the transistor 12 and by its emitter to the terminal 102.

Operation of FIG. 1 Circuit

When the power switch 3 is closed, the transistor 4 oscillates thereby generating AC high voltage in the secondary coil 51 of the oscillation transformer 5. The AC high voltage is rectified by the diode 103, and the rectified DC current flows into the main capacitor 6 through the backward-flow-preventing diode 14 and into the triggering capacitor 17 through the resistor 153, the primary coil 151 and the resistor 154. However, since a current flows from the dividing point 91 to the base of the transistor 12, the transistor 12 is made ON, thereby shortcircuiting the triggering capacitor 17. Accordingly, the triggering capacitor 17 is not charged.

When a charging of the main capacitor 6 is substantially completed and accordingly the voltage across the output terminals 101 and 102 reaches a preset level, the glow discharge lamp 13 turns ON and is lit, thereby giving a specified base current to the base of the transistor 11. Therefore, the transistor 11 becomes ON, thereby turning the transistor 12 OFF. Since the transistor 12 becomes OFF, the triggering capacitor 17 starts to be charged thereafter. The time constant of the charging of the triggering capacitor 17 is to be selected in a manner that the triggering capacitor 17 is charged, for example, within 1/10 second after the turning ON of the transistor 11.

Then, when the synchronous switch 16 is closed, the charge in the triggering capacitor 17 is discharged through the primary coil 151 of the triggering transformer 15, and accordingly a triggering pulse is generated in the secondary coil 152 and impressed on the triggering electrode 70. By means of the triggering pulse on the triggering electrode 70, the flash discharge tube 7 discharges the charge of the main capacitor 6 and flashes.

By means of the shortcircuiting of the triggering capacitor by the transistor 12 of the safety circuit 8, the function of the triggering circuit 18 is prohibited until a completion of charging of the main capacitor 6, namely until the lighting of the glow discharge lamp 13. Therefore, an inadvertent or accidental flashing with insufficient charge is prohibited.

When the flashing becomes unnecessary after a certain time period of closing the power switch 3, the power switch 3 is to be opened. Then, the DC voltage generated across the terminals 101 and 102 vanishes. By means of the diode 14, the charge of the main capacitor 6 does not flow backward to the glow discharge lamp 13. Accordingly, the transistor 11 turns OFF because its base current stops. Therefore, the transistor 12 becomes ON, thereby prohibiting the function of the triggering circuit 18. Therefore, simply by opening the power switch 3, an accidental flashing is also prohibited.

Figure 2:
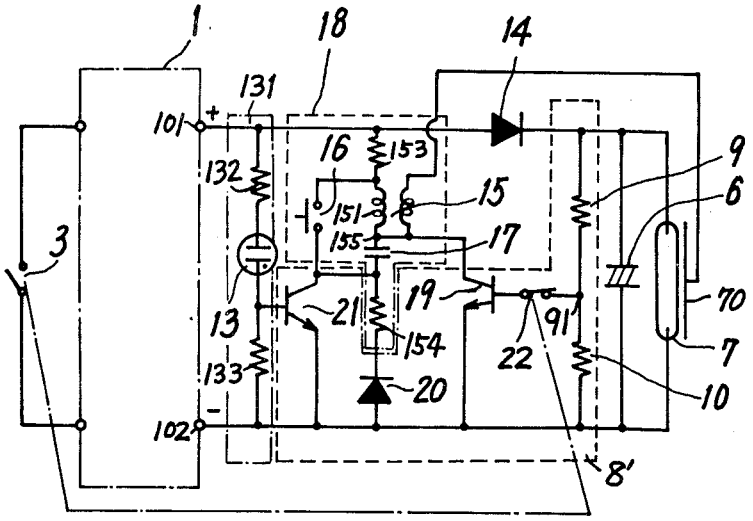
FIG. 2 is an electric circuit diagram of a modified example of the present invention.

FIG. 2 shows a circuit diagram of a modified embodiment which comprises a second switch 22 inversely interlocked with the power switch 3 of the DC power source 1, which is constructed identically to that of the circuit of FIG. 1. In a safety circuit 8', a diode 20 is connected in series with the resistor 154 in a manner to prevent a charging current to the triggering capacitor 17 through the resistor 154. The safety circuit 8' also comprises a voltage dividing network consisting of a pair of resistors 9 and 10 connected across both ends of the main capacitor 6, a transistor 19 and another transistor 21. The transistor 19 is connected by its base through the second switch 22 to the voltage dividing point 91, i.e., the junction point between the resistors 9 and 10, by its collector to the junction point 155 between the primary coil 151 and the triggering capacitor 17 and by its emitter to the output terminal 102 of the DC power source 1. The transistor 21 is connected by its base to the junction point between the glow discharge lamp 13 and the resistor 133, by its collector to the junction point between the triggering capacitor 17 and the resistor 154 and by its emitter to the terminal 102. Other parts of the circuit are constructed similarly to that of FIG. 1.

Operation of FIG. 2 Circuit

When the power switch 3 is closed, the DC current flows into the main capacitor 6. At this time, the inversely interlocked switch 22 is opened, thereby making the transistor 19 OFF. Until a completion of the charging of the main capacitor 6, the glow discharge lamp 13 is OFF, and accordingly a base current does not flow into the base of the transistor 21. Therefore, the transistor 21 is OFF. Since the transistor 21 is OFF and the diode 20 is connected in the backward direction, the trigger capacitor 17 can not be charged.

When the charging of the main capacitor 6 is substantially completed and accordingly the voltage across the output terminals 101 and 102 reaches a preset level, the glow discharge lamp 13 turns ON and is lit, thereby allowing a specified base current to flow therethrough to the base of the transistor 21. Therefore, the transistor 21 becomes ON. Accordingly, the triggering capacitor 17 is charged up. The time constant of the charging of the trigger capacitor 17 is selected in a manner that the triggering capacitor is charged, for example, within 1/10 second after turning ON of the transistor 21.

Then, when the synchronous switch 16 is closed, a triggering pulse is impressed on the triggering electrode 70, thereby causing the flash discharge tube 7 to flash.

By means of the OFF states of the transistor 21 and the diode 20, the function of the triggering circuit 18 is prohibited until a completion of charging of the main capacitor 6, namely until the lighting of the glow discharge lamp 13. Therefore, an inadvertent or accidental flashing with insufficient charge is prohibited.

When the flashing becomes unnecessary after a certain time period of closing the power switch 3, the power switch 3 is to be opened. Then, the DC voltage generated across the terminals 101 and 102 vanishes. By means of a series connection of the diode 14 to the main capacitor 6, a current cannot flow from the main capacitor 6 to the triggering capacitor 17. Simultaneously with the opening of the power switch 3, the inversely interlocked switch 22 is closed. Accordingly, a current flows from the main capacitor 6, which still retains the charge, through the resistor 9 and the switch 22, to the base of the transistor 19, thereby making the transistor 19 ON. By the turning ON of the transistor 19, the charge of the triggering capacitor 17 is discharged through the collector and emitter of the transistor 19, the diode 20 and the resistor 154. Thus, the function of the triggering circuit 18 is prohibited. Therefore, simply by opening the power switch 3, an accidental flashing is also prohibited.

Figure 3:
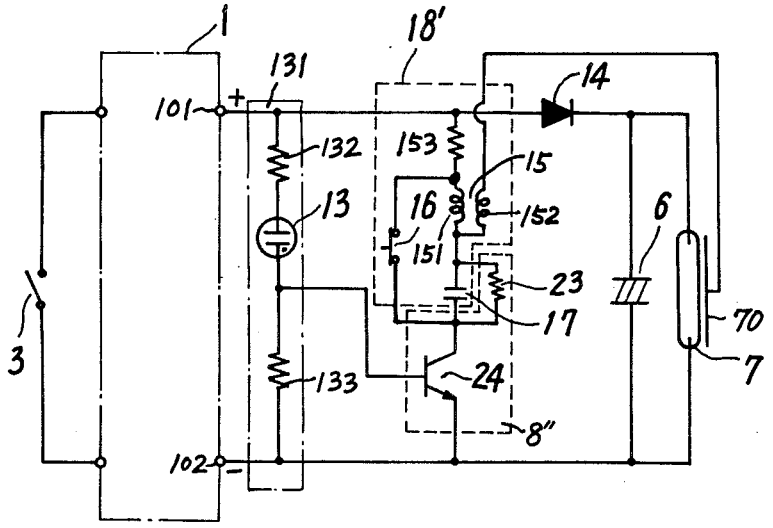
FIG. 3 is an electric circuit diagram of another modified example of the present invention.

FIG. 3 shows a circuit diagram of another modified embodiment which comprises a resistor 23 connected in parallel with a triggering capacitor 17 of a triggering circuit 18', and in place of the resistor 154 of the triggering circuit 18 as of FIG. 1, the collector-emitter circuit of a transistor 24 of a safety circuit 8'' is connected between the triggering capacitor 17 and the output terminal 102. The base of the transistor 24 is connected to the junction point between the glow discharge lamp 13 and the resistor 133. The circuit of FIG. 3 dispenses with the voltage dividing network 9, 10 as of FIG. 1 or 2. Namely, the safety circuit 8'' of this circuit of FIG. 3 comprises only the transistor 24 and the resistor 23.

Other parts of the circuit are similarly constructed to that of FIG. 1.

Operation of FIG. 3 Circuit

When the power switch 3 is closed, a DC current flows into the main capacitor 6. Until a completion of the charging of the main capacitor 6, the glow discharge lamp 13 is OFF, and accordingly, a base current does not flow into the base of the transistor 24. Therefore, the transistor 24 of the safety circuit 8'' is OFF, and hence, the triggering capacitor 17 can not be charged.

When the charging of the main capacitor 6 is substantially completed and accordingly the voltage across the output terminals 101 and 102 reaches a preset level, the glow discharge lamp 13 turns ON and is lit, thereby allowing a specified base current to flow therethrough to the base of the transistor 24. Therefore, the transistor 24 becomes ON. Accordingly, the triggering capacitor 17 is charged up. The time constant of the charging of the triggering capacitor 17 is selected in a manner that the triggering capacitor is charged, for example, within 1/10 second after turning ON of the transistor 24.

Then, when the synchronous switch 16 is closed, a triggering pulse is impressed on the triggering electrode 70, thereby causing the flash discharge tube 7 to flash.

By means of the becoming OFF of the transistor 24, the function of the triggering circuit 18' is prohibited until a completion of charging of the main capacitor 6, namely until the lighting of the glow discharge lamp 13. Therefore, an inadvertent flashing with insufficient charge is prohibited.

When the flashing becomes unnecessary after a certain time period of closing the power switch 3, the power switch 3 is to be opened. Then the DC voltage generated across the terminals 101 and 102 vanishes. By means of a series connection of the backward-current-preventing diode 14 to the main capacitor 6, a current cannot flow from the main capacitor 6 to the glow discharge lamp 13. Accordingly, the base current of the transistor 24 becomes OFF, and hence the transistor 24 is made OFF. The charge of the triggering capacitor 17 is soon discharged through the resistor 23. Accordingly, after a substantial discharging of the triggering capacitor 17, an accidental closing of the synchronous switch 16 does not make a flashing. Thus the function of the triggering circuit 18' is prohibited. The resistance of the resistor 23 is to be selected to be about equal to or several times larger than that of the resistor 153.

What I claim is:

1. A photographic flash device comprising:

a flash discharge tube having discharging and triggering electrodes, a main capacitor connected across discharging electrodes of said flash discharge tube, triggering circuit means including a triggering capacitor connected with a synchronous switch and a triggering transformer for providing a triggering pulse to said triggering electrode for flashing said flash discharge tube upon closing said switch, a voltage indicator for indicating the reaching of a specified level of the voltage of said main capacitor, a DC power source having a power switch for feeding to said indicator and main capacitor in that order a high voltage DC current when said power switch is closed, backward current preventing means connected between one end of said main capacitor and one end of said voltage indicator for allowing said DC current to flow forwardly from said source to said main capacitor while said power switch is closed and for preventing discharge current of said main capacitor from flowing backwardly from said main capacitor to said voltage indicator while said power switch is closed or open, and a safety circuit having a switching means with a control terminal which is connected to said voltage indicator for controlling the charge and discharge of said triggering capacitor respectively when the indicator indicates and stops indication of said specified voltage level.

2. A photographic flash device comprising:

a flash discharge tube having discharging and triggering electrodes, a main capacitor connected across discharging electrodes of said flash discharge tube, triggering circuit means including a triggering capacitor connected with a synchronous switch and a triggering transformer for providing a triggering pulse to said triggering electrode for flashing said flash discharge tube, a voltage indicator for indicating the reaching of a specified level of the voltage of said main capacitor, a DC power source having a power switch for feeding to said indicator and main capacitor a high voltage DC current when said power switch is closed, backward current preventing means connected between one end of said main capacitor and one end of said voltage indicator for allowing said DC current to flow forwardly from said source to said main capacitor and for preventing discharge current of said main capacitor from flowing backwardly from said main capacitor to said voltage indicator, and a safety circuit which prevents discharging of a charge of said triggering capacitor through said triggering transformer, wherein said safety circuit comprises:

network means for producing a control signal when said main capacitor has a charge, first switching means having a control electrode connected to said network means and being connected across both ends of said triggering capacitor to shortcircuit and discharge the charge of said triggering capacitor when said control signal is impressed on said control electrode, and second switching means having a control electrode connected to said voltage indicator for releasing said shortcircuiting of said first switching means when said voltage indicator is actuated by a voltage of the main capacitor exceeding a preset level.

3. A photographic flash device comprising:

a flash discharge tube having discharging and triggering electrodes, a main capacitor connected across discharging electrodes of said flash discharge tube, triggering circuit means including a triggering capacitor connected with a synchronous switch and a triggering transformer for providing a triggering pulse to said triggering electrode for flashing said flash discharge tube, a voltage indicator for indicating the reaching of a specified level of the voltage of said main capacitor, a DC power source having a power switch for feeding to said indicator and main capacitor a high voltage DC current when said power switch is closed, backward current preventing means connected between one end of said main capacitor and one end of said voltage indicator for allowing said DC current to flow forwardly from said source to said main capacitor and for preventing discharge current of said main capacitor from flowing backwardly from said main capacitor to said voltage indicator, and a safety circuit which prevents discharging of a charge of said triggering capacitor through said triggering transformer, wherein said safety circuit comprises:

an interlocked switch inversely interlocked with said power switch, network means for producing a control signal when said main capacitor has a charge, first switching means having a control electrode connected through said interlocked switch to said network means and being connected across a series connection of said triggering capacitor and a diode of backward direction against a current to charge the triggering capacitor therethrough, and second switching means having a control electrode connected to said voltage indicator to receive therefrom a control signal for developing through said second switching means acharging path for said triggering capacitor when said voltage indicator is actuated by a voltage of the main capacitor exceeding a preset level.

4. A photographic flash device comprising:

a flash discharge tube having discharging and triggering electrodes, a main capacitor connected across discharging electrodes of said flash discharge tube, triggering circuit means including a triggering capacitor connected with a synchronous switch and a triggering trnasformer for providing a triggering pulse to said triggering electrode for flashing said flash discharge tube, a voltage indicator for indicating the reaching of a specified level of the voltage of said main capacitor, a DC power source having a power switch for feeding to said indicator and main capacitor a high voltage DC current when said power switch is closed, backward current preventing means connected between one end of said main capacitor and one end of said voltage indicator for allowing said DC current to flow forwardly from said source to said main capacitor and for preventing discharge current of said main capacitor from flowing backwardly from said main capacitor to said voltage indicator, and a safety circuit which prevents discharging of a charge of said triggering capacitor through said triggering transformer, wherein said safety circuit comprises:

switching means having a control electrode connected to said voltage indicator to receive therefrom a control signal for developing through said switching means a charging path for said triggering capacitor when said voltage indicator is actuated by a voltage of the main capacitor exceeding a preset level, and a resistor connected in parallel with said triggering capacitor in a manner to discharge the charge thereof with a specified time constant therethrough.

5. A photographic flash device comprising:

a DC power source having an on-off power switch, a main capacitor connected to said power source for being charged therefrom, a flash discharge tube having discharge electrodes connected to said main capacitor and also having a trigger electrode, trigger circuit means having an output coupled to said trigger electrode and including a trigger capacitor having charging means coupled to said source and a synchronous trigger switch connected to said trigger capacitor for discharging said trigger capacitor, when said trigger switch is turned on, through a first path to said output for developing for said trigger electrode a triggering pulse to cause said main capacitor to discharge across said flash tube, control means for turning said trigger capacitor charging means on and off, and means operative when said trigger switch is turned on for preventing discharge of said main capacitor while said trigger capacitor charging means is off, including discharge means for discharging said trigger capacitor through a second path to prevent developing said triggering pulse while said charging means is off.

6. A device as in claim 5 wherein said discharge means for discharging said trigger capacitor through said second path includes a resistor across said trigger capacitor.

7. A device as in claim 5 wherein said control means includes sensing means for determining whether said main capacitor has reached a predetermined charge and switch means connected between said sensing means and trigger capacitor and controlled by said sensing means for preventing and allowing charge of said trigger capacitor respectively before and after said predetermined charge of said main capacitor is sensed by said sensing means.

8. A device as in claim 7 wherein said sensing means is connected across said power source ahead of said main capacitor, and further including:

unidirectional current conducting means connected between said sensing means and main capacitor for carrying charging current therefore forwardly from said power source to said main capacitor and for preventing discharge current from said main capacitor from flowing backwardly to said sensing means.

9. A device as in claim 8 wherein said switch means includes:

first and second tandemly connected transistors, the second of which is connected across said triggering capacitor and the first of which has an input connected to said sensing means and is turned on when said sensing means senses that said main capacitor carries a predetermined charge for turning off said second transistor to allow said triggering capacitor to charge, said second path discharge means including means for applying to said second transistor a signal for keeping said second transistor on while said main capacitor carries a charge sufficient to discharge said flash tube upon closure of said trigger switch while said power switch is on in the absence of said sensing means turning on said first transistor and also when said power switch is off.

10. A device as in claim 8 wherein said second path discharge means includes a resistor across said trigger capacitor.

11. A device as in claim 5 wherein said second path discharge means includes:

semiconductor switching means connected in said second path and having a control electrode, and means operative when said power switch is off and while said main capacitor carries a charge for applying a control signal to said control electrode, including an on-off control switch connected to said control electrode and interlocked with said power switch to be off when said power switch is on and vice versa, for causing said semiconductor switch means to be turned on for discharging said trigger capacitor.

12. A device as in claim 11 wherein said control means includes:

sensing means for determining whether said main capacitor has reached a predetermined charge, and switch means connected between said sensing means and trigger capacitor for preventing and allowing charge of said trigger capacitor respectively before and after said predetermined charge is sensed by said sensing means while said power switch is on.

13. Photographic flash device comprising:

a DC power source having an on-off power switch, a main capacitor connected to said power source for being charged therefrom, a flash discharge tube having discharge electrodes connected to said main capacitor and also having a trigger electrode, trigger circuit means having an output coupled to said trigger electrode and including a trigger capacitor having charging means coupled to said source and a synchronous trigger switch connected to said trigger capacitor for discharging said trigger circuit, when said trigger switch is turned on, through a first path to said output for developing for said trigger electrode a triggering pulse to cause said main capacitor to discharge across said flash tube, and means operative while said power switch is off, if said trigger switch is then turned on, for preventing discharge of said main capacitor, including semiconductor switch means having a control electrode and being connected across said trigger capacitor for discharging said trigger capacitor through a second path to prevent developing said triggering pulse and means including an on-off switch interlocked with said power switch so as to be off when said power switch is on and vice versa, and being connected to said control electrode for turning said semiconductor switch means on to discharge said trigger capacitor when said main capacitor carries a charge sufficient to discharge said flash tube.

* * * * *